US005573487A

United States Patent [19]

Wallner

[11] Patent Number: 5,573,487

[45] Date of Patent: Nov. 12, 1996

[54] METHOD AND APPARATUS FOR EXERCISING THE LEGS

[76] Inventor: Frank X. Wallner, 1698 Taylor Ave., St. Paul, Minn. 55104

[21] Appl. No.: 203,379

[22] Filed: Mar. 1, 1994

[51] Int. Cl.[6] ..... A63B 21/02

[52] U.S. Cl. ..... 482/124; 482/74; 482/122

[58] Field of Search ..... 482/121, 122, 482/124, 123, 125, 126, 129, 130, 74

[56] References Cited

U.S. PATENT DOCUMENTS

| | | | |
|---|---|---|---|
| 3,312,466 | 4/1967 | Melchiona | 482/126 |
| 4,815,731 | 3/1989 | Suarez et al. | 482/124 |
| 4,830,366 | 5/1989 | Ruden | 482/124 |
| 4,909,506 | 3/1990 | Smith | 482/124 |
| 5,176,600 | 1/1993 | Wilkinson | 482/124 |
| 5,205,803 | 4/1993 | Zemitis | 482/121 |

FOREIGN PATENT DOCUMENTS

| | | | |
|---|---|---|---|
| 3719719 | 12/1988 | Germany | 482/121 |

*Primary Examiner*—Lynne A. Reichard
*Attorney, Agent, or Firm*—Briggs and Morgan

[57] ABSTRACT

An exercise device comprising first and second collars for encircling the right and left legs of a user, respectively, and at least one resistance member extending between and connected to each of the collars to provide increasing resistance against angular separation of the legs through a range of flexion and extension motion. Each collar is selectively securable in a predetermined position relative to corresponding leg, preferably surrounding the knee and supporting the kneecap, or alternately surrounding the thigh or calf of the user. The natural tension provided by the resistance member may be augmented by using one or more layers of elastomeric material that provide graduated or progressively increasing levels of resistance. The device may be used to enhance the benefits of walking or running, for rehabilitative therapy, enhancement of other aerobic conditioning activities, increasing muscular flexibility and joint mobility, or strength training.

5 Claims, 4 Drawing Sheets

METHOD AND APPARATUS FOR EXERCISING THE LEGS

BACKGROUND OF THE INVENTION

1. Field of the Invention

This invention relates generally to a method and device for progressive resistance exercise of the legs, and particularly the muscles responsible for flexion and extension of the legs about the diarthroses (synovial) joints of the lower extremities.

2. Prior Art

Many devices and exercises are known for strengthening the muscles associated with the legs, with primary emphasis being placed on the agonists or prime movers within the groups of depressors, levitators, flexors, extensors, abductors, and adductors. These groups are most frequently exercised in conditioning activities such as aerobic exercise, stair climbing, weight training, and so forth.

Devices for treating injuries and providing rehabilitative therapy to these groups have also been developed, however little or no treatment has been given to the ability to provide progressive resistance therapy to the flexor and extensor muscle groups responsible for flexion and extension of the legs about the diarthroses (synovial) joints of the lower extremity, primarily the coxal (hip) and secondarily the tibiofemoral (knee) joints. Injuries to these muscle groups (or rehabilitative therapy subsequent to trauma to the associated joints) are usually addressed by one or a combination of weight training or moderate aerobic exercise.

BRIEF SUMMARY OF THE INVENTION

It is therefore one object of this invention to design a device capable of providing progressive resistance exercise isolated to the muscle groups responsible for flexion and extension of the leg while walking or performing other leg flexing exercises.

It is a related object of this invention to design the above device such that embodiments of the basic design may be easily modified for use in rehabilitative therapy, enhancement of aerobic conditioning activities, increasing muscular flexibility and joint mobility, or strength training, and similarly may be adjusted to accommodate users of various sizes and capacities.

It is another object of this invention to design the above device such that it may be utilized during light, moderate, or heavy aerobic activities to augment overall physical conditioning and strength training.

It is a distinct object of this invention to design the above device so as to minimize the rotational forces on the tibiofemoral (knee) joint, to thereby limit the potential for secondary injuries during rehabilitative therapy (including walking) and to provide support for the patella during aerobic activity and strength training.

Briefly described, the exercise device of this invention includes first and second collars for encircling the right and left legs of the user, respectively, and at least one resistance member extending between and connected to each of the collars to provide increasing resistance against angular separation of the legs through a range of flexion and extension motion. Each collar is selectively securable in a predetermined position relative to corresponding leg, preferably surrounding the tibiofemoral (knee) joint and supporting the patella, or alternately surrounding the thigh or calf of the user. The natural tension provided by the resistance member may be augmented using one or more layers of elastomeric material that provides graduated or progressively increasing levels of resistance.

DESCRIPTION OF THE PREFERRED EMBODIMENTS

Figure 2:
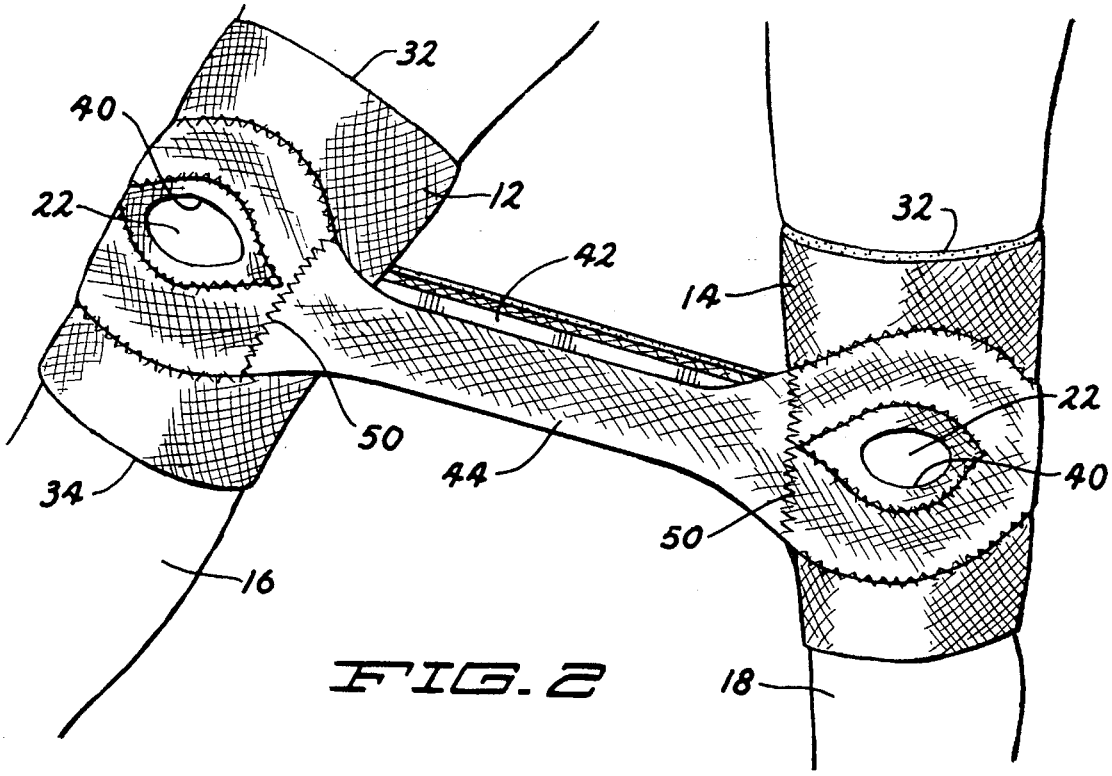
FIG. 2 is a perspective view of the exercise device of this invention shown on the legs of a user conducting stationary leg lifts, the right leg of the user being separated abductively and elevated angularly from the sagittal or midsagittal plane.

The progressive resistance exercise device of this invention is shown in FIGS. 1–8 and referenced generally therein by the numeral 10.

Referring particularly to FIGS. 1–5 and 8, the exercise device 10 includes a first collar 12 and second collar 14 each shaped and sized so as to encircle the right leg 16 or left leg 18 of the user, respectively, in the area adjacent to and including the tibiofemoral (knee) joint 20 and patella (knee cap) 22.

Each collar 12, 14 is fabricated from a flexible, elasticized, resilient polymer sheet material that retains warmth and wicks moisture, such as a fabric-coated high-density Neoprene® of the type conventionally used in athletic braces. The material preferably permits repeated deformation within a defined range without degradation of its elasticity, and can be sewn or sealed using thermal or adhesive bonds.

Referring particularly to FIGS. 1–5, each collar 12, 14 is secured in place surrounding the corresponding leg 16, 18 in the region of the knee 20 using patches 24 and bands 26 of mating hook-and-loop fastener or a similar fastening means attached to the exterior side 28 and interior side 30 of the corresponding collar 12, 14. The collars 12, 14 may each be wrapped around the leg 16, 18 of the user and secured in the preferred position with the patches 24 and bands 26 of mating hook-and-loop fastener overlapping and engaging one another as shown particularly in FIGS. 1, 3, and 4 to permit the diameter of the collars 12, 14 and the constrictive pressure placed on the knees 20 or legs 16, 18 of the user to be adjusted as desired according to their personal preference and comfort.

Referring again to FIGS. 1–5, it may be seen that each collar 12, 14 is tapered from its top edge 32 top to its bottom edge 34 to accommodate the natural taper of the legs 16, 18 of the user, and this taper may be increased or decreased as necessary by angling the front edge 36 and rear edge 38 of each collar 12, 14 relative to one another when the patches 24 and bands 26 of mating hook-and-loop fastener are connected and secured together. As a representative example, collars 12, 14 having a nominal diameter along the top edge 32 of approximately 16" and along the bottom edge of 34 of 15" have proven suitable for a majority of potential users when the patches 24 extend 2¾" inwardly from the rear edge 38 and the bands 26 extend 1" inwardly from the front edge 36. Collars 12, 14 having a height of 8¼" at a line bisecting the patella 22 and 7½" in the region of the front edge 36 and rear edge 38 have proven suitable, each with two patches 24 each having a 2" height spaced apart and positioned adjacent to the top edge 32 and bottom edge 34 of the collar 12, 14. Alternately, other conventional means for tensioning and shaping the collars 12, 14 to conform to the natural shape of the user's leg 16, 18 and to moderate the constrictive pressure applied by the collars 12, 14 may be utilized.

Figure 1:
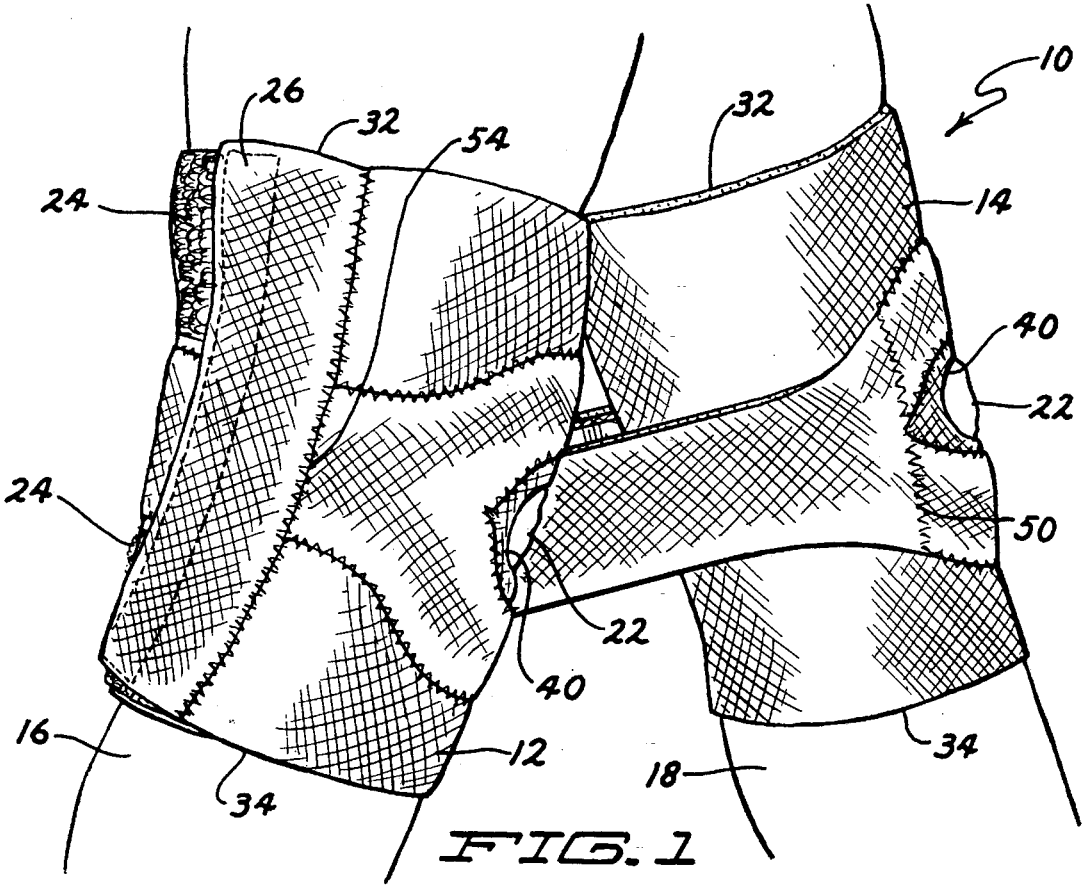
FIG. 1 is a perspective view of the exercise device of this invention shown on the legs of a user while walking, the left leg of the user exhibiting extension from the frontal plane and the right leg exhibiting flexion from the frontal plane.
Figure 3:
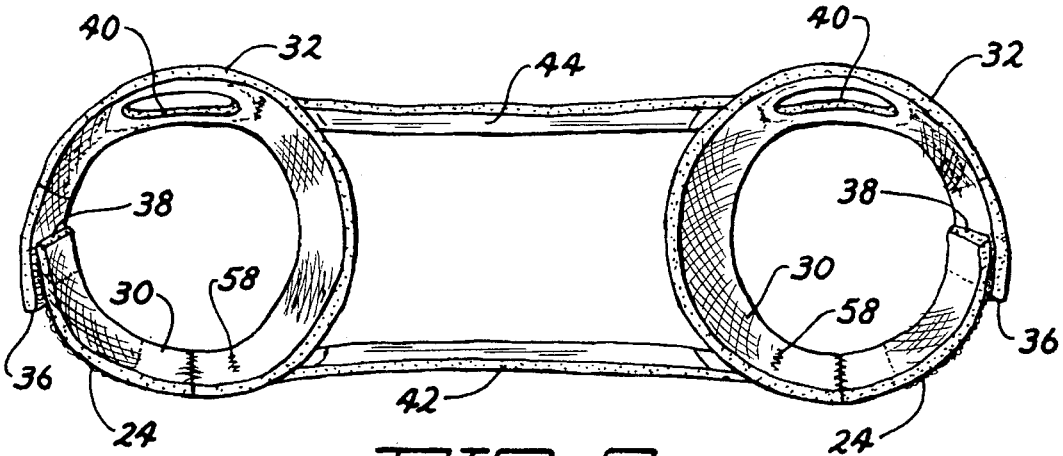
FIG. 3 is a top plan view of the exercise device of FIG. 1.
Figure 4:
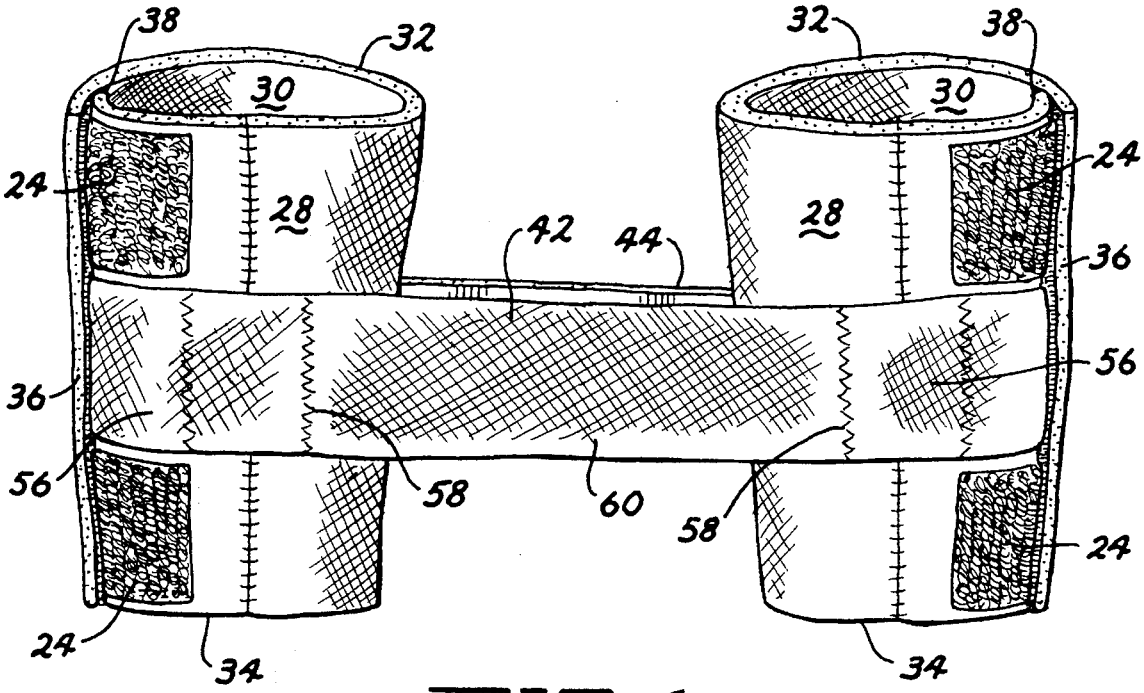
FIG. 4 is a rear elevation view of the exercise device of FIG. 1.
Figure 5:
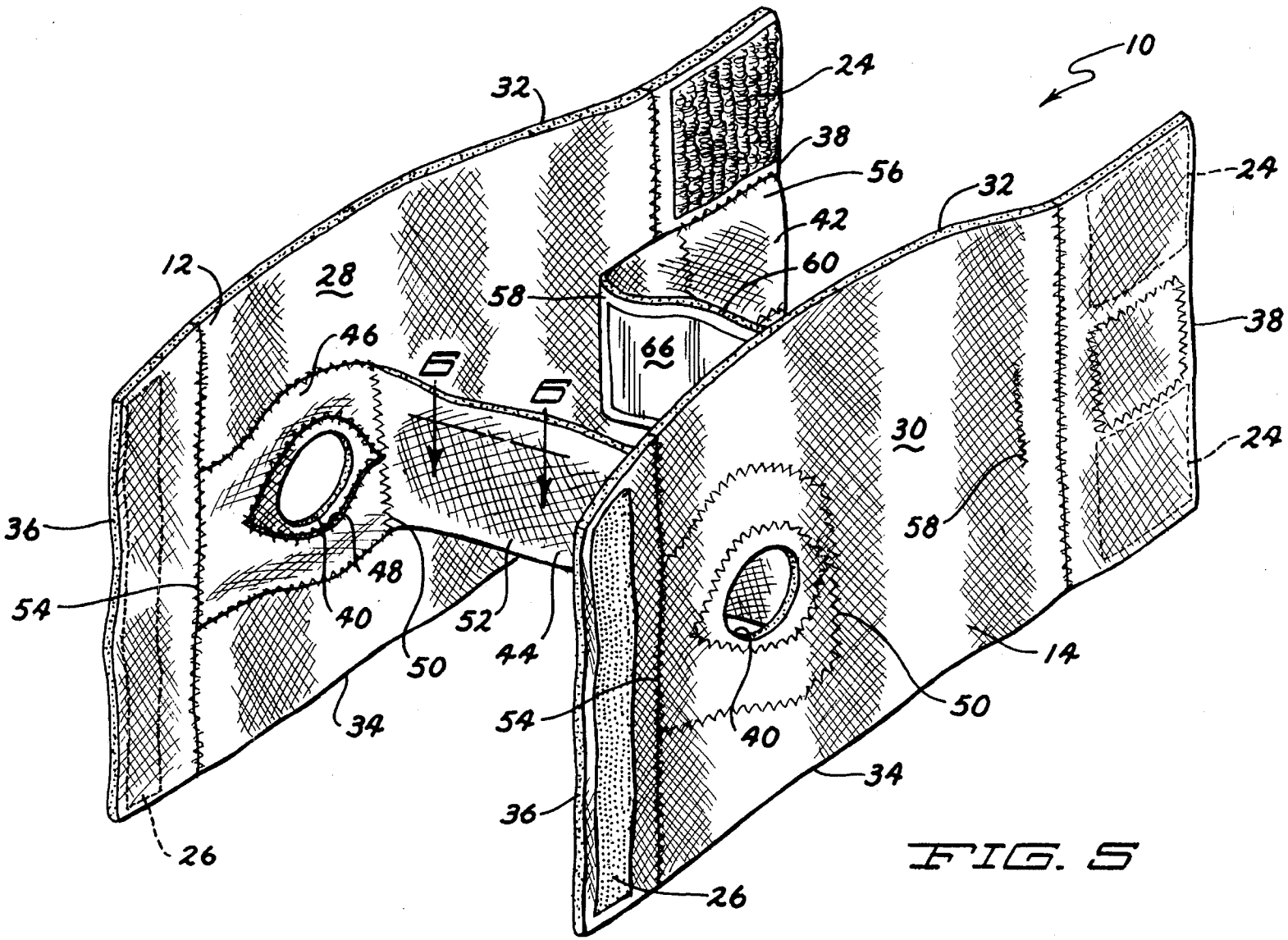
FIG. 5 is a perspective view of the exercise device of FIG. 1 in an open position.

Referring to FIGS. 1–3, it may be seen that each collar 12, 14 defines an opening 40 extending through the front side thereof to accommodate the corresponding left or right patella 22 (knee cap) of the user. Each opening 40 is generally circular in shape as shown in FIG. 5, and distorts to a generally oval shape as shown in FIG. 2 when the collars 12, 14 are secured in position surrounding the legs 16, 18 of the user. Openings having a nominal diameter of approximately 1½" diameter have proven suitable.

Extending between and connected to each of the collars 12, 14 are a pair of resistance members 42, 44. Each resistance member 42, 44 is fixedly attached to the exterior surface 28 of each collar 12, 14, with the front resistance member 44 having a portion 46 which completely crosses the front of the corresponding leg 16, 18 and encircles the patella 22 and similarly defines a generally oval-shaped opening 48 therefore. The portions 46 of the front resistance members 44 crossing the front of the legs 16, 18 are each fixedly attached to the exterior surface of the collars 12, 14 on opposing sides of the patella 22, and similarly define a generally oval-shaped opening 48 therefore.

One suitable configuration includes front resistance member having an unstretched or unflexed length of approximately 17" including a pair of front portions 46 which each extend forward approximately 6" from the corresponding generally vertical posterior attachment lines 50, thereby permitting a 5" intermediate segment 52 disposed between the pair of front portions 46. The intermediate segment 52 has a height of approximately 2½", with the front portions 46 tapering from a minimum height of 2½" along the posterior attachment lines 50 and front attachment lines 54 to a maximum of approximately 5¾" at a line bisecting the opening 40 for the patella 22. At least attachment line 54 and a portion of the peripheral edges of the front portions 46 are fixedly attached to the collars 12, 14, and up to the entire surface area of the front portions 46 may be fixedly attached to the collars 12, 14 in any manner that does not restrict the flexibility and elasticity of the collars 12, 14 and the front resistance member 44.

The rear resistance member 42 has an unstretched or unflexed length on the order of 14¼" with a uniform height of approximately 2½". Rear portions 56 defined by the rear resistance member 42 are fixedly attached along generally vertical anterior attachment lines 58 and along the peripheral edges thereof, with the anterior attachment lines 58 being spaced approximately 4" from the ends of the respective rear portions 56 and defining a 6" intermediate segment 60. As with the front portions 46, at least the peripheral edges of the rear portions 56 are fixedly attached to the collars 12, 14, and up to the entire surface area of the rear portions 56 may be fixedly attached to the collars 12, 14 in any manner that does not restrict the flexibility and elasticity of the collars 12, 14 and the rear resistance member 42.

Figure 6:
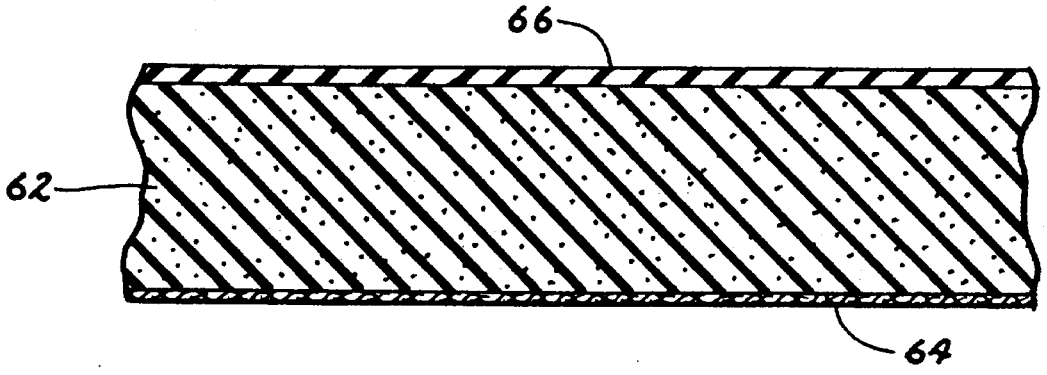
FIG. 6 is a partially broken away cross section view of the exercise device of FIG. 1 taken through line 6—6 in FIG. 5.
Figure 7:
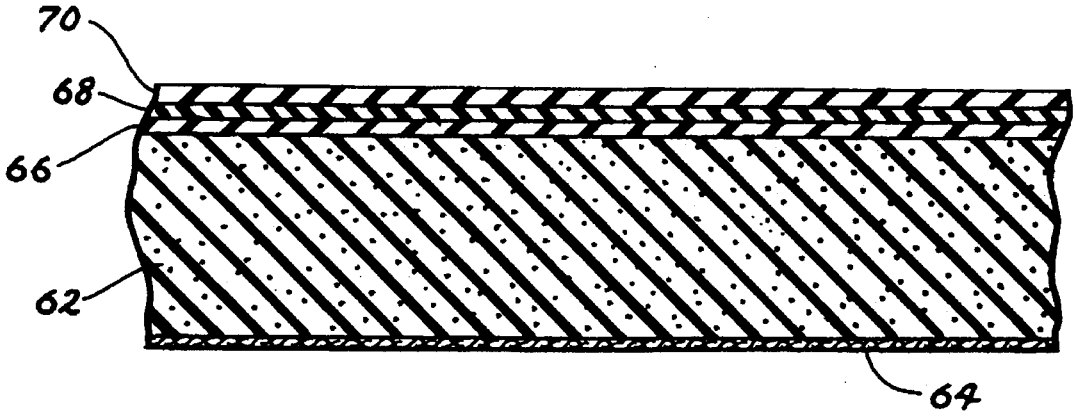
FIG. 7 is a partially broken away cross section view of the exercise device of FIG. 1 taken through line 6—6 in FIG. 5.

Referring particularly to FIGS. 6 and 7, a cross-section of the intermediate segment 52 of the front resistance member 44 is provided which shows the Neoprene® base layer 62 and fabric coating 64 plus one or more layers of progressive resistance material 66–70 attached to the base layer 62, or alternately to the intervening layers of the progressive resistance material 66–68. Referring also to FIG. 5, the progressive resistance material 66–70 may be attached or affixed to the intermediate segment 60 of the rear resistance member 42 as well as the intermediate segment 52 of the front resistance member 44, and may extend between or may overlap the posterior attachment lines 50 or attachment lines 58 or both. The progressive resistance material is preferably a highly elastic synthetic polymer such as pure latex, with each layer 66–70 having a thickness generally linearly proportional to the degree or level of resistance to longitudinal distortion that is provided by the respective layer 66–70 throughout a predetermined range of resistances for very thin layers 66–70.

One example of a suitable progressive resistance material is the Thera-Band® System of Progressive Resistance that utilizes pure latex produced in rolls of 6"×18' of varying thicknesses and resistances, each being color-coded to designate a predetermined resistance level. The progressive resistance material serves both the purpose of providing graduated or progressively increasing levels of resistance to the stretching of the front resistance member 44 or rear resistance member 42 or both, and to reinforce or support the base layer 62 so that the base layer 62 does not absorb the entire force or tension, thereby minimizing the degradation of its elasticity resulting from the repeated stretching of the resistance members 42, 44.

It may be readily appreciated by those of ordinary skill in the art that the type and level of progressive resistance material used in the additional layers 66–70, as well as the properties and characteristics of the sheet material forming the base layer 62, may be selected so as to optimize the resistance level and durability of the exercise device 10 depending upon the health or strength of the user and the intended use of the exercise device 10 during walking or running, in rehabilitative therapy, enhancement of aerobic conditioning activities, increasing muscular flexibility and joint mobility, or strength training.

In operation, the user places the first collar 12 in surrounding relation to their right leg 16 with the opening 40 aligned with their patella 22, and stretches the collar 12 to the desired fit and secures the collar 12 in place by overlapping the patches 24 and band 26 of mating hook-and-loop fastener and pressing them into contact with one another. The user then secures the second collar 14 around the left leg 18 in the same manner.

Referring to FIGS. 1 and 2, the user may then alternately flex and extend their right and left legs 16, 18 in opposition about their corresponding coxal (hip) joints, with the tension or resistance caused by the resistance members 42, 44 increasing proportionately with the separation of the collars 12, 14 due to the rearward angular flexion and forward angular extension of the legs 16, 18 relative to a frontal plane of the user. Due to the manner in which the resistance members 42, 44 are fixedly attached to the collars 12, 14, the resistance members 42, 44 will remain generally parallel with one another throughout the normal range of rearward angular flexion and forward angular extension of the legs 16, 18. The tension produced by the resistance members 42, 44 will be generally linearly proportional to the length that each resistance member 42, 44 is stretched, and will therefore not be linearly proportional to the degree of angular separation between the legs 16, 18 of the user.

The user may utilize the exercise device 10 when taking walking or running strides with both legs 16, 18, or alternately by lifting one leg 16 or 18 from a standing or seated position using either a forward extension or rearward flexion of the thigh portion of the leg 16 or 18.

Referring particularly to FIGS. 1 and 2, the forward extension or rearward flexion of the legs 16, 18 about the coxal (hip) joint as shown in FIGS. 1 may be differentiated from abductive motion of one or both legs 16, 18 away from the midline of the user as shown in FIG. 2. While the exercise device 10 of this invention may be modified or adjusted to provide resistances suitable for exercising the muscles associated with abduction or adduction of the legs 16, 18, the normal tension or resistance used for exercising the muscles responsible for flexion and extension of the legs 16, 18 would limit abduction (or crossed-leg adduction) exercises.

Figure 8:
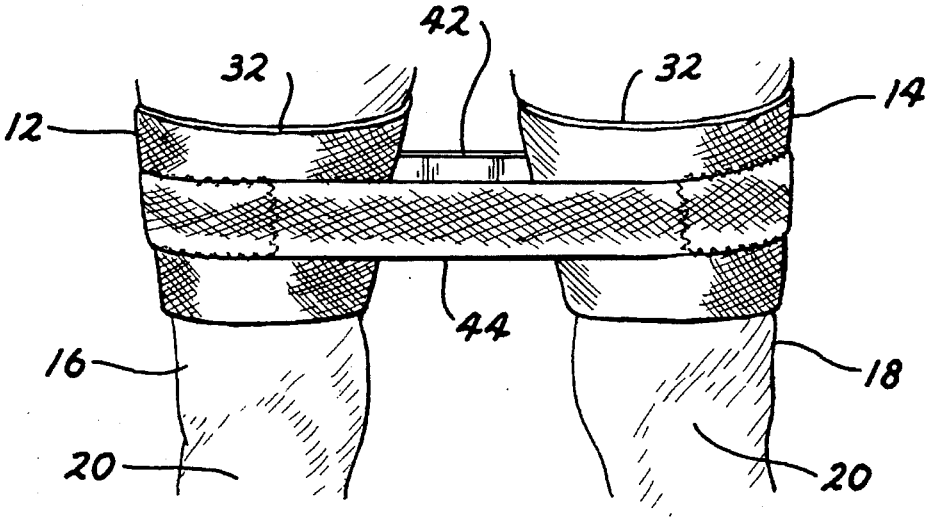
FIG. 8 is a perspective view of an alternate embodiment of the exercise device of FIG. 1 shown on the thigh portion of the legs of a user.

Referring to FIG. 8, it may be seen that an alternate embodiment of the exercise device 10 which is secured to the legs 16, 18 of the user above the knees 20 in the region of the thigh is shown, that embodiment providing increased resistance or tension in the resistance members 42, 44 (or alternately a constant tension or resistance for use with patient's having limited strength, flexibility, or mobility) and omitting the openings 40 surrounding the patella 22. In such a case, the front regions 46 of the front resistance member 44 need not be tapered to a greater height, but may remain at a constant or uniform height throughout its length.

In either embodiment of the exercise device 10, it may be appreciated that if the unstretched length of the intermediate segments 52, 60 of the resistance members 42, 44 is greater than the normal separation of the legs 16, 18 of the user when the legs 16, 18 pass one another along the vertical frontal plane of the user during a normal stride, then a certain amount of slack will be present in the resistance members 42, 44 unless the length of the resistance members 42, 44 is made sufficiently short or the elasticity sufficiently great such that there is constant positive tension or resistance applied to the collars 12, 14 by the resistance members 42, 44 even when the collars 12, 14 are disposed at their closest displacement (i.e., separation) throughout a normal stride. In the event that slack is present, intermediate segments 52, 60 would not be of sufficient length to interfere with motion. It is preferred that the degree of tension or resistance be sufficiently low such that movement of the legs 16, 18 through the portion of a stride encompassing the transition between slack and positive tension or resistance does not produce a noticeable jarring or jerking motion which would unintentionally result in interference or injury.

It may further be appreciated that the normal range of motion of the legs 16, 18 of the user when wearing the exercise device encompasses: (1) zero angular separation of either leg 16, 18 from the vertical frontal plane of the user, (2) forward extension or rearward flexion of either leg 16, 18 while the opposing leg 18, 16 remains in position at or near the vertical frontal plane, or (3) forward extension of one leg 16, 18 and rearward flexion of the opposing leg 18, 16, in each case such that a separation angle is formed between a first longitudinal centerline of the thigh of the right leg 16 and a second longitudinal centerline of the thigh of the left leg 18, with the range or possible separation angles that may be utilized for resistance exercise extending from 0° to greater than 90°, and with the useful range being from approximately 5°–10° to approximately 90°–120°. Separation angles greater than approximately 120° will result in a minimal incremental increase in resistance as the separation angle increases and are therefore less useful for rehabilitative therapy or aerobic conditioning (but may be suitable for some applications involving increasing muscular flexibility, joint mobility, or strength training at advanced levels) and for most applications resistance at separation angles less than 5°–10° will not permit sufficient slack to accommodate normal striding movement and may result in tensions when the resistance members 42, 44 are completely stretched that limit a normal stride.

As a representative example of the utility of the exercise device 10 of this invention, the preferred embodiment of the exercise device 10 as described above for use surrounding the knees 20 of the legs 16, 18 of the user in which there is slack in the resistance members 42, 44 until a linear separation of approximately 6" or more as measured between the most medial superficial points of the opposing knees 20 is reached, and with tension or resistance increasing generally proportionally to the linear separation until a maximum separation of approximately 14"–15" is achieved. Such an embodiment permits a normal to extended walking or running stride, with resistance being applied only after the middle portion of the normal stride is surpassed, with little or no torsional forces being applied to the knees 20 of the user. This preferred embodiment is particularly effective during walking or running regimens to enhance aerobic conditioning without interfering with or modifying normal coordination of the stride, and to increase the strength and flexibility of the muscles responsible for extension and flexion of the legs 16, 18 (with flexion being emphasized by slower walking steps rather than running strides). The embodiment may also be used to provide resistance in overstriding exercises to increase normal stride length.

It may be appreciated that defined regimens of physical or rehabilitative therapy may be devised for the treatment of particular injuries, conditions, or recovery from certain trauma, with graded protocols being established based upon the health and strength of the patient and coordinated with predetermined resistance levels and embodiments of the exercise device 10 of this invention. Furthermore, particular embodiments of the exercise device 10 of this invention may be adapted and better suited for use in the enhancement of aerobic conditioning activities, increasing muscular flexibility and joint mobility, or strength training for certain types of patients, athletes, or sports.

It is further understood that variations of the preferred embodiment may include the capability of adjusting or setting the desired resistance level by adding or subtracting resistive elements from the resistance members 42, 44, such as by applying greater or lesser numbers of additional layers 66–70 or by increasing the length of the resistive members 42, 44 relative to the collars 12, 14, or various combinations of these modifications.

While the preferred embodiments of the above exercise device 10 have been described in detail with reference to the attached drawing Figures, it is understood that various changes and adaptations may be made in the exercise device 10 without departing from the spirit and scope of the appended claims.

What is claimed is:

1. An exercise device for use by a person having a right leg and a left leg, the right leg and the left leg being capable of rearward angular flexion and forward angular extension relative to a frontal plane of the user, said exercise device comprising:

a first collar for encircling the right leg of the user, said first collar having means for selectively securing said first collar in a predetermined position relative to the right leg;

a second collar for encircling the left leg of the user, said second collar having means for selectively securing said second collar in a predetermined position relative to the left leg; and at least one resistance member extending between and connected to each of said first collar and said second collar, said at least one resistance member providing increasing resistance against the angular separation of the left leg and the right leg of the use;

wherein each collar includes an opening therein to accommodate the user's patella, the distance between said openings defining a linear separation and wherein said at least one resistance member has an unstretched position and a stretched position, said unstretched position corresponding to said linear separation being on the order of 6" or less and said stretched position corresponding to said linear separation being on the order of 14" or more;

whereby the left leg and the right leg of the user may be flexed or extended by the user, and said at least one resistance member will increase the resistance applied against such motion to the right leg and the left leg through said first collar and said second collar generally proportionally to the separation of said first collar and said second collar due to the combined flexion and extension of the right leg and the left leg of the user.

2. An exercise device for use by a person having a right leg and a left leg, the right leg and the left leg being capable of rearward angular flexion and forward angular extension relative to a frontal plane of the user, said exercise device comprising:

a first collar for encircling the right leg of the user, said first collar having means for selectively securing said first collar in a predetermined position relative to the right leg:

a second collar for encircling the left leg of the user, said second collar having means for selectively securing said second collar in a predetermined position relative to the left leg; and at least one resistance member extending between and connected to each of said first collar and said second collar, said at least one resistance member providing increasing resistance against the angular separation of the left leg and the right leg of the user, wherein said at least one resistance member includes a base layer of a sheet material having a natural tension when stretched, said exercise device further comprising:

a supplemental resistance means, said supplemental resistance means providing additional tension greater than the natural tension of said base layer of said sheet material, whereby the resistance of said base layer of said resistance member is augmented by said supplemental resistance means;

whereby the left leg and the right leg of the user may be flexed or extended by the user, and said at least one resistance member will increase the resistance applied against such motion to the right leg and the left leg through said first collar and said second collar generally proportionally to the separation of said first collar and said second collar due to the combined flexion and extension of the right leg and the left leg of the user.

3. The exercise device of claim 2 wherein said supplemental resistance means includes at least one layer of a progressive resistance material, said at least one layer of said progressive resistance material being connected to said base layer.

4. The exercise device of claim 3 wherein said at least one layer of said progressive resistance material is latex.

5. The exercise device of claim 2 wherein said supplemental resistance means includes more than one layer of said progressive resistance material, said more than one layer of said progressive resistance material being connected to said base layer.

* * * * *